United States Patent [19]

Ruble

[11] Patent Number: 4,678,893

[45] Date of Patent: Jul. 7, 1987

[54] METHOD AND MEANS FOR DETERMINING THE EASE WITH WHICH A COW MAY GIVE BIRTH TO A CALF

[75] Inventor: Marshall V. Ruble, Kelley, Iowa

[73] Assignee: Iowa State University Research Foundation, Inc., Ames, Iowa

[21] Appl. No.: 854,536

[22] Filed: Apr. 22, 1986

[51] Int. Cl.[4] ..... G06G 1/02

[52] U.S. Cl. ..... 235/70 R; 235/70 A

[58] Field of Search ..... 235/69, 70 R, 70 A

[56] References Cited

U.S. PATENT DOCUMENTS

| | | | |
|---|---|---|---|
| 1,378,993 | 5/1921 | Boehnke | 235/70 A |
| 2,585,595 | 2/1952 | Spencer | 235/70 R |
| 3,589,021 | 6/1971 | Hall | 33/372 |
| 3,918,164 | 11/1975 | Krautmann | 33/143 C |
| 4,037,327 | 7/1977 | Hildebrand | 33/169 R |
| 4,097,997 | 7/1978 | Bjornson | 33/15 D |
| 4,138,999 | 2/1979 | Eckhart et al. | 128/660 |
| 4,201,226 | 5/1980 | Phillips | 128/774 |
| 4,425,713 | 1/1984 | Rotella | 33/515 |
| 4,429,749 | 2/1984 | Nelms | 168/45 |

OTHER PUBLICATIONS

Article Entitled "He Uses Pelvic Scores", Successful Farming Feb., 1981.

*Primary Examiner*—Benjamin R. Fuller

*Attorney, Agent, or Firm*—Zarley, McKee, Thomte, Voorhees & Sease

[57] ABSTRACT

The present invention comprises a method and device for determining the ease with which a cow may give birth to a calf. It includes a slide rule having two movable slides and a fixed slide. The fixed slide includes a predicted calving score scale at one end thereof and a hoof circumference scale at the other end thereof. One of the moving slides includes a pelvic height scale, and the other moving slide includes a pelvic width scale.

The method of the present invention involves measuring the pelvic height and pelvic width of a cow which is about to give birth to a calf. Next, the hoof circumference of the calf is measured prior to the time that it is born. The measured pelvic height, pelvic width, and hoof circumference are lined up on the slide rule and this results in indicators on the two movable slides being positioned adjacent a predicted calving score. The predicted calving score indicates the ease with which the cow will give birth to a calf.

4 Claims, 4 Drawing Figures

METHOD AND MEANS FOR DETERMINING THE EASE WITH WHICH A COW MAY GIVE BIRTH TO A CALF

BACKGROUND OF THE INVENTION

The present invention relates to a method and means for determining the ease with which a cow may give birth to a calf.

The ability to determine the ease with which a cow will give birth to a calf is very important for livestock producers during the calving season. If difficulties in a particular birth are anticipated, then special precautions can be taken to insure that both the cow and calf come through the calving alive and well. Obviously, the cost of production and efficiency of production can be greatly enhanced if the number of calves lost during the calving is minimized.

The difficulty with which a cow gives birth to a calf can be categorized according to the following four situations:

(1) Situations where the cow can give birth to a healthy calf on her own.

(2) Situations where the cow may encounter some difficulty, but this difficulty can be overcome by pulling the calf by hand.

(3) Situations where the cow will encounter difficulty during calving, but this difficulty can be overcome by the use of a mechanical calf puller.

(4) Situations where a caesarean birth is required.

The difficulty with which a cow gives birth to a calf depends upon several factors. One of these factors is the size of the cow's pelvic area. Another factor is the weight of the particular calf. Various attempts have been made to determine a correlation between the weight of the calf and the size of the cow's pelvic area. An example of such an attempt is described in an article by Bill Miller entitled "He Uses Pelvic Scores" in the February 1981 issue of Successful Farming magazine. In this article, a method is described whereby the pelvic height and pelvic width of the cow are multiplied by one another and divided by a factor for the age of the cow to determine the calf birth weight which the cow should be able to deliver without assistance.

One problem encountered with the above method, however, is that there is difficulty in determining the weight of the calf prior to the time that it is born. Without knowing the weight of the calf about to be born, it is difficult to determine the ease with which the cow will give birth to the calf.

Therefore, a primary object of the present invention is the provision of an improved method and means for determining the ease with which a cow may give birth to a calf.

A further object of the present invention is the provision of a method and means for determining the ease with which a cow may give birth to a calf, wherein the weight of the calf may be estimated shortly prior to the time that the calf is born.

A further object of the present invention is the provision of a device which permits the easy calculation of a calving score for determining the ease with which a cow may give birth to a calf.

A further object of the present invention is the provision of a method and means which can be used easily in the pasture or field where the cow is located.

A further object of the present invention is the provision of a method and means which will improve the mortality rate of calves being born by making possible the determination of when a cow requires assistance in calving and by making a further determination of the particular type of assistance the cow may require.

SUMMARY OF THE INVENTION

The present invention utilizes the discovery that a calf's weight can be estimated reasonably accurately prior to the time the calf is born by measuring the hoof circumference of the calf after its mother's cervix dilates, but before it is born. During labor, the calf is usually presented for delivery with its front feet first, and therefore it is possible to measure the circumference of the calf's foot prior to the time that the calf is being born.

The pelvic areas of the cows are measured rectally with a Krautman Bovine Litton Pelvic Meter such as described in U.S. Pat. No. 3,918,164, approximately two or six weeks prior to the birth of the calf.

A slide rule device is used to correlate and compare the measured pelvic height and pelvic width of the cow in relationship to the hoof circumference measured from the calf. The slide rule is used to calculate a calving score which is used to predict the ease with which a cow will give birth to the calf. A calving score of 1 indicates that the cow can give birth to the calf unassisted. A calving score of 2 indicates some assistance with manual pulling of the calf is required. A calving score of 3 indicates that a mechanical calf puller is required. A calving score of 4 indicates that caesarean section is required.

The slide rule includes a movable slide with a pelvic height scale thereon; a movable slide with a pelvic width scale thereon; and a stationary member with a hoof circumference scale at one end and a calving score scale at the other end. The two movable scales are moved to line up the respective pelvic height and pelvic width measured in the cow with the hoof circumference measured in the calf. Indicator marks on the sliding scales move adjacent the various calving scores on the fixed scale during sliding movement of the sliding scales. When the pelvic height measurements and pelvic width measurements of the sliding scales are lined up with the hoof circumference of the calf, the indicator marks are positioned adjacent the appropriate calving score which appears on the fixed scale.

Because the pelvic height scale may show one calving score and the pelvic width scale may show another calving score, the appropriate applicable calving score can be determined by the approximate midpoint between the two scales. This provides a very reliable method for determining the ease with which the calf will be born. The operator, armed with the information provided by the slide rule, can provide the appropriate aid to the cow during the calving operation and this results in improved mortality and health of the calves being born.

DETAILED DESCRIPTION OF THE PREFERRED EMBODIMENT

Figure 1:
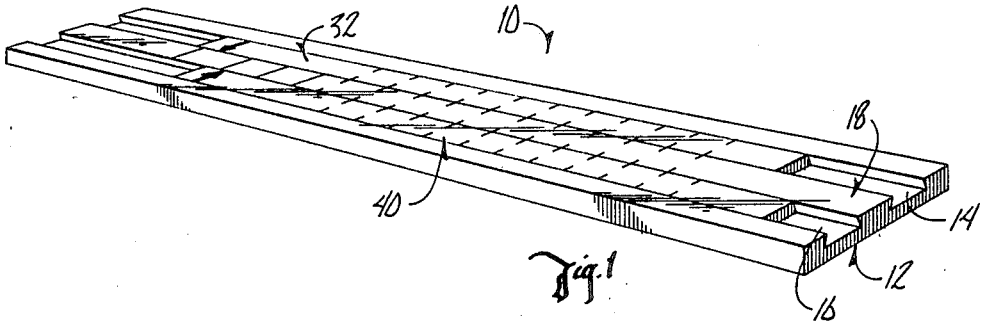
FIG. 1 is a perspective view of the slide rule of the present invention.

Referring to the drawings, the numeral 10 generally designates the slide rule of the present invention. Slide rule 10 includes a base frame 12 having two elongated slide channels 14, 16 therein. In the drawings, the slide channels are shown to have a dove-tail cross-sectional configuration, but other means such as grooves or keyed slots could be used to provide retention of the slides within the slide channels.

An elongated fixed scale member 18 is centrally provided on the base frame and includes a calving score scale 20 at one end and a hoof circumference scale 22 at the other end. Calving score scale 20 includes a plurality of increment markings 24 thereon and adjacent increment markings 24 are a plurality of calving score indicia 26 which are numbered 1 through 4.

Hoof circumference scale 22 includes a plurality of calibration marks 28, and adjacent each of these calibration marks 28 is a hoof circumference indicia 30 which represents in centimeters the hoof circumference measured on the calf prior to the time it is born.

Slidably mounted within channel 14 is an elongated pelvic height slide 32 having an indicator mark or arrow 34 thereon adjacent one end thereof. Extending along the length of pelvic height slide 32 are a plurality of pelvic height calibration marks 36 having a plurality of pelvic height indicia 38 adjacent thereto. The pelvic height indicia 38 represent the measured pelvic height of the cow in centimeters and are spaced equi-distant from one another on the pelvic height slide.

A pelvic width slide 40 is slidably mounted within channel 16 and includes an indicator mark or arrow 42 adjacent one end thereof. Pelvic width slide 40 is substantially the same as pelvic height slide 32, and includes calibration marks 44 and pelvic width indicia 46 which are spaced apart equally from one another, and which represent the pelvic width measured from the cow in centimeters.

The pelvic height calibrations 36, the pelvic width calibrations 44, and the hoof circumference calibrations 28 are all positioned equi-distant apart so that it is possible to register the calibrations of the pelvic height slide, the pelvic width slide and the hoof circumference member with one another. The predicted calving score calibrations 24, however, are not positioned equi-distant from one another, but are spaced apart predetermined graduated distances from one another so that the calving score calculated by the slide rule is determined according to the following table:

| Actual Calving Score | (0–4) | (4.1–5.5) | (5.6–6.5) | (6.6–7.5) |
|---|---|---|---|---|
| Predicted Calving Score | 1 | 2 | 3 | 4 |

where the raw data score is calculated according to the following formulas:

Actual calving score for Pelvic Height =

(hoof circumference Pelvic Height + 3.5)

Actual calving score for Pelvic Width =

(hoof circumference Pelvic Width + 3.5)

-continued

Actual calving score for both pelvic height and pelvic width =

$$\frac{(\text{hoof circumference} - \text{pelvic height} + 3.5) + (\text{hoof circumference} - \text{pelvic width} + 3.5)}{2}$$

The pelvic height slide calculates the predicted calving score using the first formula above in combination with the table. The pelvic width slide calculates the predicted calving score using the second formula above in combination with the table.

In order to determine the ease with which the cow will give birth to the calf, it is necessary to average the actual calving score obtained under the first formula above with the actual calving score obtained under the second formula above. For example, if the actual calving score calculates to be 2.5 under the first formula above and calculates to be 3.2 under the second formula above, the average of these two actual calving scores would be 2.85 which falls into the predicted calving score of 1. Therefore, the cow can be expected to deliver the calf without aid.

Prior to using the slide rule of the present invention, it is necessary to take the appropriate measurements from the cow and the calf. The pelvic areas of the calves are preferably measured with a Krautman Bovine Litton Pelvic Meter two to six weeks prior to the birth of the calf. The device for taking this measurement is shown in U.S. Pat. No. 3,918,164. The method for taking these measurements is known in the art. The measurement for the vertical pelvic height is taken between the cow's sacrum on top and the cow's pubic spine on the bottom. The pelvic width is measured between the two ilea shafts of a cow's pelvic bone. This method for measuring the pelvic height and width of a cow is described in an article by Bill Miller entitled "He Uses Pelvic Scores" in the February 1981 issue of Successful Farming magazine.

The hoof circumference of the calf should be taken approximately one hour after labor has begun. At this time the circumference of the calf's hoof is measured around the coronary band in centimeters to the nearest tenth of a centimeter. A flexible tape measure may be used for this purpose, but the measurement should be as accurate as possible, and should be taken around the coronary band of the calf's hoof. It has been found through experimentation that there is a strong correlation between the birth weight of the calf and the circumference of the calf's hoof, as measured in the manner described above. As the hoof circumference increases, so does the birth weight of the calf in a linear fashion. A correlation of 0.84 between the birth weight of the calf and the hoof circumference has been observed through experimentation.

Figure 2:
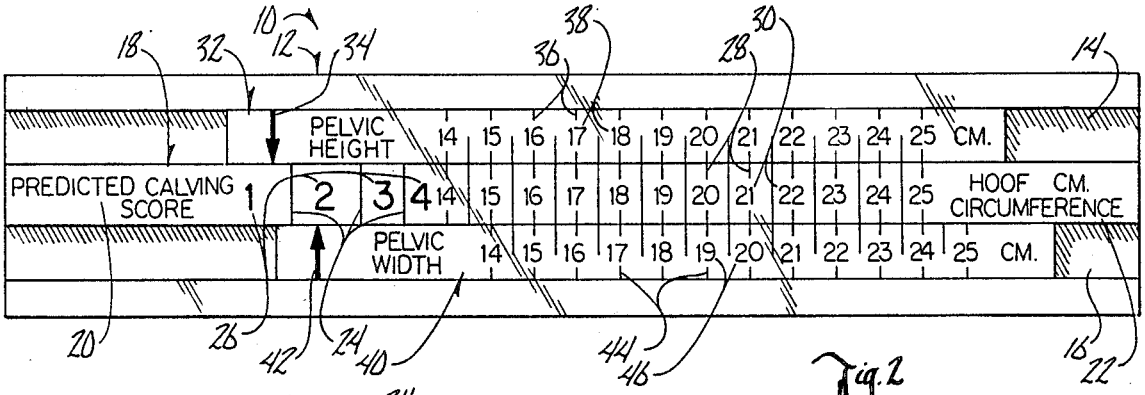
FIG. 2 is a top plan view of the slide rule.

After the measurement of the cow's pelvic height and width are taken, and after the measurement of the calf's hoof circumference has been taken, the slide rule of the present invention is used to calculate the ease with which the cow will give birth to the calf. In order to use device 10, the operator moves the two movable slides 32, 40 so that the pelvic height, pelvic width, and hoof circumference measured above will register with one another. For example, in FIG. 2, the hoof circumference of 16 centimeters is shown registered with a pelvic height of 16 centimeters and a pelvic width of 15 centimeters. Similarly, the hoof circumference of 17 centimeters is shown registered with a pelvic height of 17 centimeters and a pelvic width of 16 centimeters. After the measured pelvic height, width and hoof circumference have been registered in alignment with one another, it is possible to read the predicted calving score resulting from this configuration. Arrows 34, 42 are aligned adjacent the predicted calving scores resulting from these measurements. For example, in FIG. 2 the predicted calving score calculated by using pelvic width is shown to be approximately 2.4 and the predicted calving score for calculations using the pelvic height is shown to be approximately 1.8.

Figure 3:
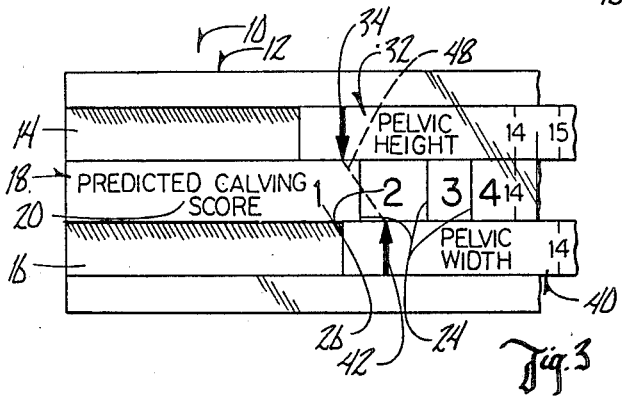
FIG. 3 is a partial top view of the slide rule showing an example of a position of the slides for determining the calving score.

FIG. 3 shows how these two scores are averaged to determine the ease with which the cow will give birth to the calf. By drawing a line diagonally across between the two arrows 34, 42, it can be determined the the average calving score is slightly greater than 2 by observing the approximate midpoint of the diagonal line designated by the numeral 48. Thus, the predicted calving score for this particular cow-calf combination is approximately 2.1. This means that the cow will require manual aid in delivering the calf.

Figure 4:
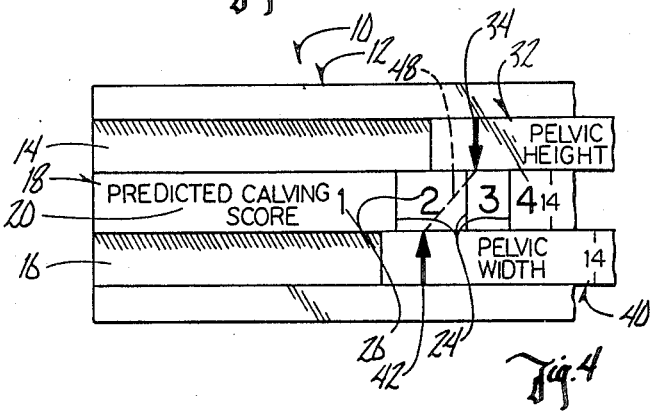
FIG. 4 is a view similar to FIG. 3, but showing the slides in a slightly different position.

FIG. 4 illustrates another example. The example in FIG. 4 will result from measurements of 15 centimeters for the pelvic height, 17.5 centimeters for the hoof circumference, and 16.4 centimeters for the pelvic width. This results in a predicted calving score of approximately 3.3 using the pelvic height measurement, and a predicted calving score of approximately 2.4 using the pelvic width measurement. The average predicted calving score of the two as designated by the line 48, and is well within the predicted calving score range of 2. Therefore, the calf can be anticipated to be born easily with the use of manual pulling.

The spaces between the calibrations 24 in the calving score scale vary from one another and are selected so that the arrows will align with the various predicted calving scores in accordance with the table and formulas identified above.

The device of the present invention has proven very successful in making a determination of what type of aid is required for the cow during the time of calving. It helps the operator to know when a caesarean operation is needed or when the calf may require either mechanical pulling means or manual pulling means. This knowledge enables the person attending the cow-calf unit to provide the proper aid and thereby increase the mortality and health of the calves being produced.

Thus, it can be seen that the device accomplishes at least all of its stated objectives.

What is claimed is:

1. A device for calculating a predicted calving score for a cow which is about to give birth to a calf; comprising:

a frame means;

a first elongated member on said frame means and having a first end, a second end, a front face, an upper edge and a lower edge, said front face of said first elongated member having a predicted calving score scale at said first end thereof and a hoof circumference scale at said second end thereof;

a second elongated member having first and second opposite ends and a front face, said front face of said second elongated member having an indicator mark adjacent said first end thereof and having a pelvic height scale thereon;

a third elongated member having first and second opposite ends and having a front face, said front face of said third elongated member having an indicator mark adjacent said first end thereof and having a pelvic width scale thereon;

all of said pelvic height scale, said pelvic width scale, and said hoof circumference scale being divided into equal units of length;

said predicted calving score being divided into units of length which are unequal to each other and which are unequal to said units of length of said pelvic height, pelvic width, and hoof circumference scales;

said second elongated member being movably mounted on said frame means adjacent said upper edge of said first elongated member for longitudinal sliding movement with respect thereto to a plurality of positions where selected units of said pelvic height scale are in register with selected units of said hoof circumference scale and said indicator mark of said second elongated member is in register with one of said units of said predicted calving score scale;

said third elongated member being movably mounted on said frame means adjacent said lower edges of said first elongated member for longitudinal sliding movement with respect thereto to a plurality of positions where selected units of said pelvic width scale are in register with selected units of said hoof circumference scale and said indicator mark of said third elongated member is in register with one of said units of said predicted calving score scale, whereby said predicted calving score may be calculated by extending a line from said indicator mark of said second elongated member across said predicted calving score scale to said indicator mark of said third elongated member, said average predicted calving score being indicated by the one of said units of said predicted calving score scale located at the midpoint of said line.

2. A device according to claim 1 wherein each of said units of said predicted calf score scale, said hoof circumference scale, said pelvic height scale, and said pelvic width scale, includes a numerical indicia mark thereon.

3. A device according to claim 2 wherein said units of said predicted calving score scale comprise first, second, third, and fourth calving score units, said numerical indicia of each of said pelvic height, pelvic width, and said hoof circumference representing the group numerals extending from 14 through 25.

4. A method for using a calculator for calculating a predicted calving score for a cow which is about to give birth to a calf, said calculator comprising first, second and third elongated members, said second and third elongated members being on opposite sides of said first elongated member and being longitudinally slidable with respect thereto; said first elongated member having a hoof circumference scale at one end thereof and a predicted calving score scale at the opposite end thereof; said second and third elongated members having a pelvic height scale and a pelvic width scale thereon respectively, said pelvic height scale, said pelvic width scale, said hoof circumference scale and said predicted calving score scales each being divided into pelvic height units, pelvic width units, hoof circumference units, and predicted calving score units respectively; said second and third elongated members having first and second indicator marks respectively adjacent one end thereof; said method comprising:

measuring the pelvic height of said cow to obtain a measured pelvic height value;

measuring the pelvic width of said cow to obtain a measured pelvic width value;

measuring the hoof circumference of one of the front hooves of said calf before said calf is born to obtain a measured hoof circumference value;

moving said second elongated member to a position relative to said first member wherein the one of said pelvic height units on said pelvic height scale corresponding to said measured pelvic height value is registered with the one of said hoof circumference units on said hoof circumference scale corresponding to said measured hoof circumference value, whereby said first indicator mark will be moved adjacent one of said predicted calving score units;

moving said third elongated member to a position relative to said first member wherein the one of said pelvic width units on said pelvic width scale corresponding to said measured pelvic width value is registered with said one of said hoof circumference units corresponding to said measured hoof circumference value, whereby said second indicator mark will be moved adjacent one of said predicted calving score units;

drawing a line from said first indicator mark across said predicted calving score scale to said second indicator mark whereby the predicted calving score for said cow and said calf is indicated by the one of said predicted calving score units which is located at the midpoint of said line.

* * * * *